United States Patent [19]

Wert, Jr.

[11] 4,382,157

[45] May 3, 1983

[54] MULTIPLE SPEAKER TYPE SOUND PRODUCING SYSTEM

[75] Inventor: Kenneth P. Wert, Jr., Elysburg, Pa.

[73] Assignee: Kenneth P. Wert, Sr., Irvine, Calif.

[21] Appl. No.: 52,721

[22] Filed: Jun. 28, 1979

Related U.S. Application Data

[63] Continuation-in-part of Ser. No. 925,533, Jul. 17, 1978, abandoned.

[51] Int. Cl.[3] ..... H04S 1/00

[52] U.S. Cl. ..... 179/1 G; 179/1 GA

[58] Field of Search ..... 179/1 G, 1 GA, 1 GP, 179/1 E, 1 AT, 100, 4 ST; 84/DIG. 1, DIG. 27; 369/86

[56] References Cited

U.S. PATENT DOCUMENTS

| | | | |
|---|---|---|---|
| 2,819,342 | 1/1958 | Becker | 179/1 G |
| 3,060,266 | 10/1962 | Dow | 179/1 G |
| 3,280,258 | 10/1966 | Curtis | 179/1 G |
| 3,342,923 | 9/1967 | Henley | 84/DIG. 27 |
| 3,818,115 | 6/1974 | Hirano | 84/DIG. 27 |

OTHER PUBLICATIONS

"Phantom Channel for Stereo," by Burstein in Electronics World, Jun. 1959, pp. 46, 47 & 80.

"Adding the Third Channel", Audiocraft, in High Fidelity, Apr. 1959, pp. 109, 125, 126.

"Complete Systems, Loudspeaker/Room Relationships", in Wireless World, Aug. 1955, pp. 11–14.

*Primary Examiner*—Douglas W. Olms

*Attorney, Agent, or Firm*—Harvey B. Jacobson

[57] ABSTRACT

A plurality of speaker devices are driven by two stereophonic audio signal sources through a signal distributing circuit having impedance means for equalizing the amplitudes of the driving signals applied to the speaker devices. The speaker devices thereby radiate sound to a point of listening symmetry for a more accurate reproduction of the sound radiation pattern corresponding to the stereophonic recordings from which the audio signal sources are derived.

7 Claims, 6 Drawing Figures

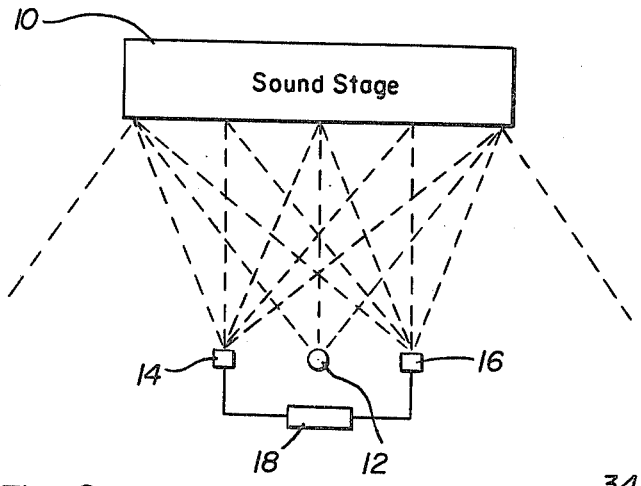
Fig. 1
Fig. 2
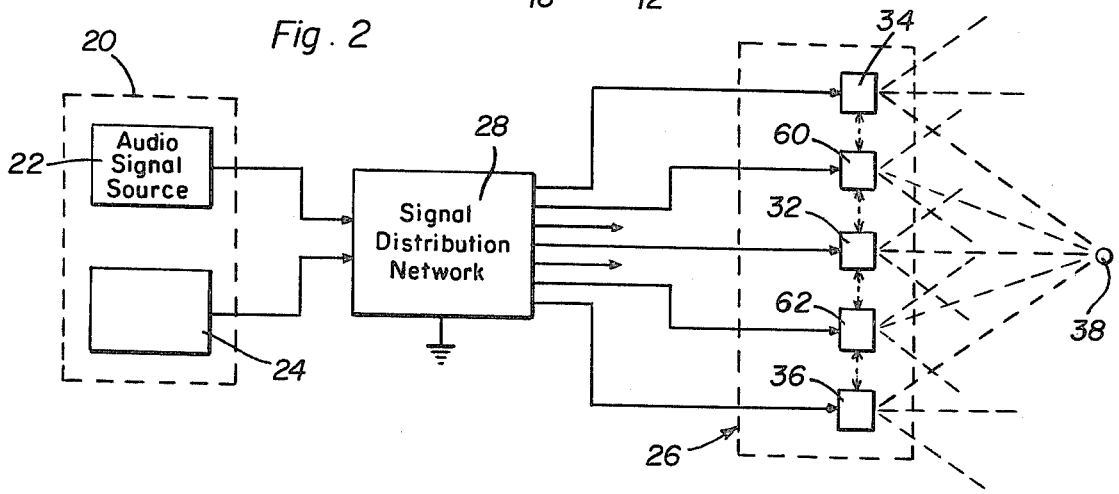
Fig. 3
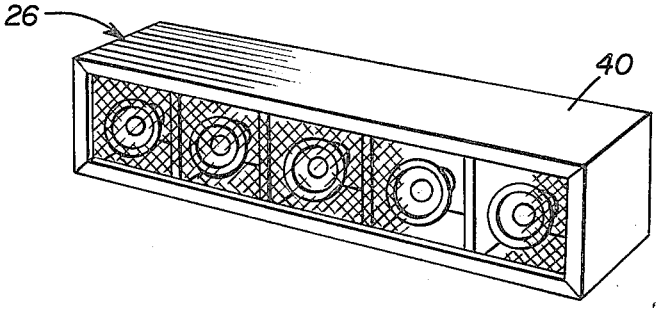
Fig. 4
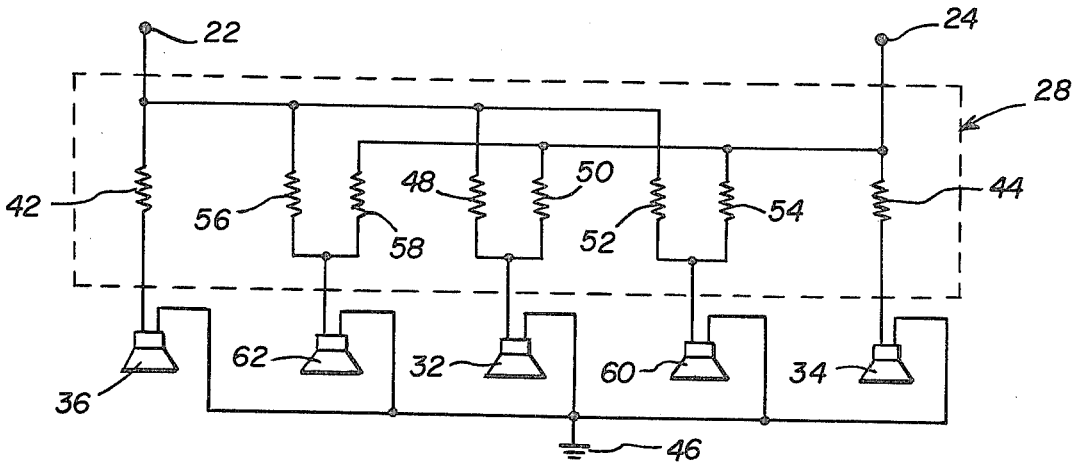

MULTIPLE SPEAKER TYPE SOUND PRODUCING SYSTEM

CROSS-REFERENCE TO RELATED APPLICATION

This invention pertains to improvements in the stereophonic reproduction of sound and is related to the subject matter in my prior copending application Ser. No. 925,533, filed July 17, 1978, now abandoned, with respect to which the present application is a continuation-in-part.

BACKGROUND OF THE INVENTION

Generally, stereophonic sound reproduction systems involve two speakers connected to audio signal sources derived from recordings of multi-frequency sound of common origin generated externally of the system at spaced locations in a sound radiation listening zone. In this manner, an attempt is made to simulate the differences in pressure, time and phase of the sound pickup by the left and right ears of a listener in a sound radiation listening zone. Although two stereophonic speakers are generally driven by separate audio signals which differ from each other with respect to the aforementioned sound characteristics to create a more realistic perception of sound as compared to monaural systems, a faithfully complete reproduction of the sounds is not possible because the sound radiation pattern within the listening zone is not taken into account.

In an effort to improve the impression of realism, an increase in the number of speakers has been proposed, such as four speakers in a quadrophonic system. In such a system, the two dimensional nature of the stereophonic system is enlarged to a three dimensional system. Such enlargements of the basic stereophonic system not only introduce complexities with respect to differences in the signals fed to each of the speakers, but also create an artificial volumetric zone within which the listener is to be confined. Other multi-speaker systems involve the creation of various artificial sound effects, including the introduction of acoustical delays and polar effects.

It is, therefore, an important object of the present invention to provide an improved stereophonic sound reproduction system which will more completely and effectively utilize the recorded stereophonic information without introducing any artificial effects or establishing any artificial zonal limits.

Another object of the present invention is to provide a stereophonic reproduction system which will more faithfully simulate the location of a listener within the audience zone associated with the sounds being recorded.

SUMMARY OF THE INVENTION

In accordance with the present invention, an odd number of five or more speakers are driven by two stereophonically related audio signal sources. The signals from these audio signal sources are applied to an array of axially parallel speakers located in symmetrical relation to each other in a multiple speaker assembly for projecting sounds along parallel directions. The speaker driving signals derived from the two sources are attenuated for substantially equalizing the signal currents driving the speakers. Toward that end, the speaker devices at opposite ends of the array are respectively coupled to the signal sources independently of each other, while the intermediate speakers are coupled to both signal sources through a signal distribution network. The intermediate speakers thereby receive fixed percentages of the signal energy from both signal sources in order to obtain equal signal levels at each of the speakers. The signal distribution network utilizes either resistive or inductive impedances to obtain equal signal amplitudes at the speakers without time or phase correction. In this manner, more faithful reproduction of the sound radiation pattern is obtained while at the same time the stereophonic characteristics of the sounds are preserved for reproduction by the speakers at opposite ends of the array.

These together with other objects and advantages which will become subsequently apparent reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

FIG. 1 is a simplified top schematic view of a prior art stereophonic recording system.

FIG. 2 is a block diagram depicting the basic sound reproduction system of the present invention.

FIG. 3 is a perspective view illustrating a typical multiple speaker assembly to be utilized as part of the present invention.

FIG. 4 is an electrical circuit diagram showing one embodiment of the signal distributing network associated with the present invention.

DETAILED DESCRIPTION OF THE PREFERRED EMBODIMENTS

Figure 5:
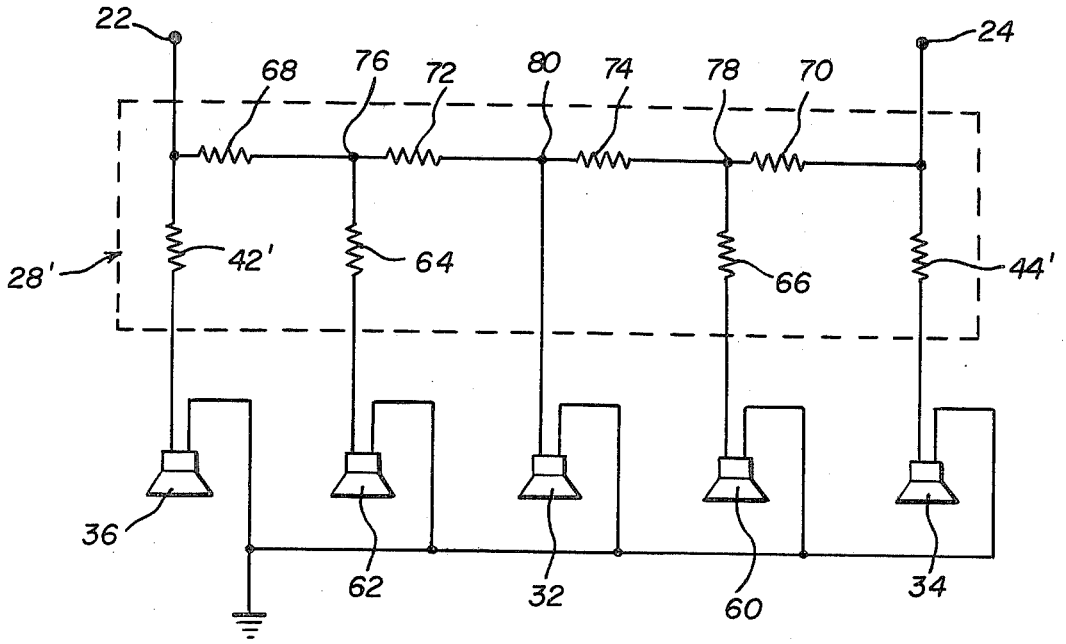
FIG. 5 is an electrical circuit diagram showing a second embodiment of the signal distributing network associated with the present invention.

Referring now to the drawings in detail, FIG. 1 illustrates a typical stereophonic recording arrangement in which sounds radiating from a plurality of points on a sound stage 10 are perceived by a listener 12 on either side of which are located sound pickup devices 14 and 16. The pickup devices feed signals to a stereophonic recorder 18 through which two stereophonically related recordings are produced in a manner well-known in the art. The two stereophonic recordings are utilized in a stereophonic signal generating apparatus 20 of conventional design as depicted in FIG. 2 having right and left output channels 22 and 24 constituting the stereophonically related audio signal sources with which the sound reproduction system of the present invention is associated.

With continued reference to FIG. 2, the outputs of the stereophonically related signal sources 22 and 24 drive a multiple speaker assembly generally referred to by reference numeral 26 through a signal network 28. An odd number of speaker devices make up the multiple speaker assembly, including a central speaker device 32 driven by signals from both sources 22 and 24 and end speaker devices 34 and 36 independently driven by signals from sources 22 and 24, respectively. Equal numbers of intermediate speaker devices 60 and 62 are located on opposite sides of the central speaker device 32 so as to form a symmetrical arrangement relative to some theoretical listening point 38 in a plane common to parallel axes of the speakers, whereby the sound radiation pattern associated with the speaker assembly 26 closely resembles the radiation pattern emanating from the sound stage 10, from a geometric standpoint. The network 28 is operative to distribute the speaker driving signals originating from sources 22 and 24 amongst the speaker devices in order to obtain a simulation of the sound radiation pattern, from a sound level standpoint, without disturbing the stereophonic differences in signal characteristics respectively associated with the end speaker devices 34 and 36. The number of intermediate speakers 60 and 62 may be increased to meet different reproduction requirements.

FIG. 3 illustrates a typical multiple speaker assembly 26 having an enclosure 40 within which at least five axially parallel speaker devices are mounted in equally spaced relation to each other in a horizontal direction within separated chambers. In the embodiment illustrated, the speaker devices are mounted on a baffle board in the usual manner.

FIG. 4 shows the circuitry of the signal distribution network 28 through which the signal sources 22 and 24 apply appropriate signal currents to the positive terminals of the end speaker devices 34 and 36 through voltage dropping resistors 42 and 44. Each of the other speakers 32, 60 and 62 receives a combination of signal currents from both signal sources such that the sum of such signal currents is equal to the signal current conducted through end speaker 34 or 36. Thus, the positive terminal of the central speaker 32 is electrically coupled to both signal sources through resistors 48 and 50. Resistors 52 and 54 couple intermediate speaker 60 to both signal sources while resistors 56 and 58 couple speaker 62 to the two signal sources. The negative terminals of all speakers are connected to common ground.

The resistive impedances in the network 28 have resistance values necessary to equalize the speaker driving currents. Assuming equal signal levels at the two signal sources 22 and 24 for a five speaker array, the resistors 42 and 44 would be selected so as to have equal resistance values. In such case, resistors 52 and 54 coupled to the intermediate speaker 60 are respectively provided with one and one-half (1.5) and three (3) times the resistance value of resistor 44 while resistors 56 and 58 coupled to speaker 62 are respectively provided with resistance values of one and one-half (1.5) and three (3) times the resistance of resistor 42 in order to obtain equal speaker driving currents. The resistors 48 and 50 coupled to the central speaker 32 will then have resistance values twice that of resistor 42 or 44. The foregoing relationship between the resistive impedances is only applicable to a five speaker array. This relationship must be modified when additional intermediate speakers and resistors are added to the array in order to obtain the signal attenuation necessary for equalizing the speaker driving currents.

The same signal distributing function is achieved by the signal distributing network 28' as shown in FIG. 5 wherein voltage dropping resistors 42' and 44' directly couple the sources 22 and 24 to the positive terminals of the end speakers 34 and 36, respectively, as in the case of network 28. Voltage dropping resistors 64 and 66 are also coupled to the positive terminals of intermediate speakers 60 and 62. Voltage dividing resistors 68, 70, 72 and 74 are interconnected in series between the two signal sources to establish junctions 76 and 78, to which the speakers 60 and 62 are coupled by resistors 64 and 66, and junction 80 to which the positive terminal of central speaker 32 is directly connected. The negative terminals of all speakers are connected to common ground.

To equalize speaker driving currents through network 28', all of the voltage dividing resistors 68, 70, 72 and 74 are provided with the same resistance value as resistor 42' or 44'. Resistors 64 and 66 are provided with resistance values that are $\frac{1}{4}$ of the resistance of the resistor 42' or 44'. Appropriate modification of the resistive imedance relationship must be made for speaker arrangements of more than five speakers, in order to obtain equal speaker driving currents.

Figure 6:
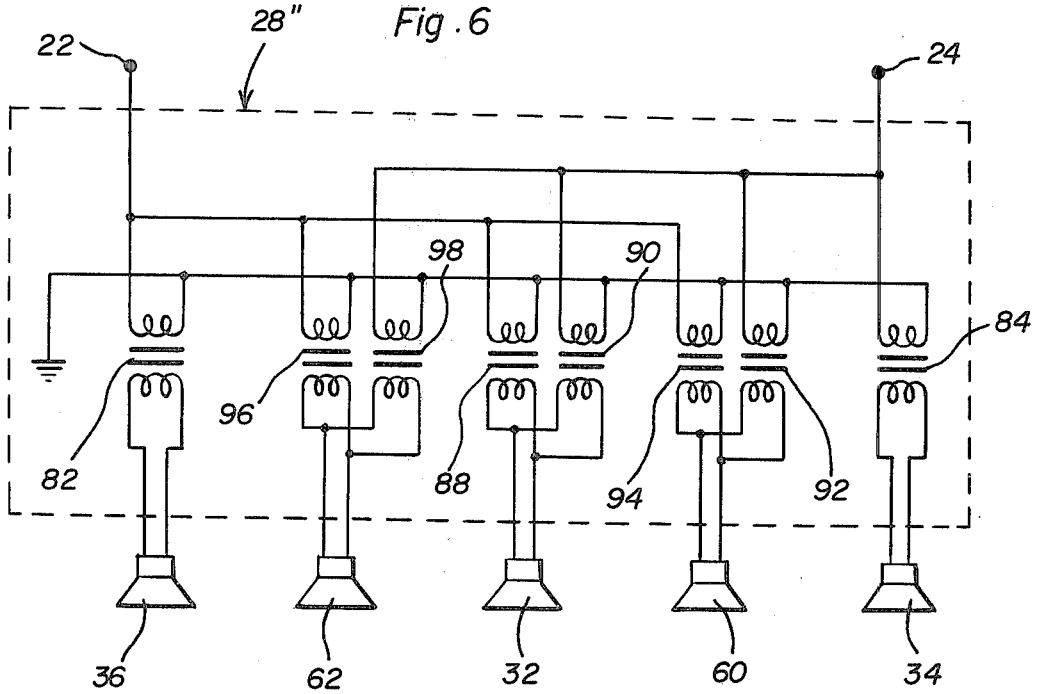
FIG. 6 is an electrical circuit diagram showing a third embodiment of the signal distributing network.

According to the embodiment of FIG. 6, a signal distributing network 28'' accomplishes signal amplitude equalization by use of signal transformers having different inductive impedances at least for the primary windings. Single transformers 82 and 84 respectively couple the signal sources 22 and 24 to the end speakers 34 and 36 by having their primary windings connected between the signal source and a common ground line 86. Each of the central and intermediate speakers 32, 60 and 62 are coupled to both of the signal sources through a pair of transformers. Thus, transformers 88 and 90 have their primary windings connected between the ground line 86 and the two signal sources, respectively, while their secondary windings are connected in parallel across the terminals of the central speaker 32. Pairs of transformers 92 and 94 and 96 and 98 are connected in a similar arrangement between intermediate speakers 60 and 62 and the two signal sources 22 and 24.

The impedance relationship between the transformers of the network 28'' is such as to obtain equal speaker driving currents in the transformer secondary windings to which the speakers are connected. For the five speaker array shown, the foregoing objective is achieved by a sum of the outputs from each pair of speaker coupling transformers equaling the output from a single transformer 82 or 84 coupled to the end speaker 34 or 36. The outputs of transformers 82 and 90 coupled to the central speaker 32 are each 50% of the output of transformer 82 or 84. The outputs of transformer 92 and 94 are respectively 75% and 25% of the output of transformer 84. Similarly, the outputs of the transformers 96 and 98 are 75% and 25% of the output of transformer 82. The transformer impedance relationship must, of course, be modified for a larger speaker array in order to obtain the same circuit balance in the signal distributing network.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An apparatus for generating at least four audio output channels from first and second stereophonically related audio signals, said output channels including a leftmost channel, a rightmost channel, and at least two intermediate channels, said apparatus comprising:

a plurality of speakers, each said audio output channel being operatively connected to one of said speakers, said speakers being oriented in an ordered series in front of a listener such that the leftmost speaker, for output of said leftmost channel, is at the listener's left; the rightmost speaker, for output of said rightmost channel, is at the listener's right; and each intermediate speaker, for output of each said intermediate channel, is positioned therebetween, with half on one side of a midpoint between said leftmost and rightmost speakers and half on the opposite side;

means for attenuating said first signal out as an unmixed signal of said leftmost output channel;

means for attenuating said second signal out as an unmixed signal of said rightmost output channel; and means in each said intermediate channel for coupling a portion of each said first and second signals out as said intermediate output channels including:

means for mixing a predetermined amplitude portion of said first audio signal with a predetermined amplitude portion of said second audio signal said means comprising:

means for coupling a lesser amplitude portion from said signal to each said intermediate channel, the amplitude thereof being a function of the distance that the corresponding intermediate speaker is away from said leftmost speaker and nearer to said rightmost speaker; and means for coupling a lesser amplitude portion from said second signal to each said intermediate channel, the amplitude thereof being a function of the distance that the corresponding intermediate speaker is away from said rightmost speaker and nearer to said leftmost speaker to the same extent that said amplitude portion from said first signal is lessened in amplitude in the opposite direction from said leftmost speaker;

said attenuating means and mixing means including equalizer means, for equalizing the relative amplitudes of said unmixed and mixed signals, such that the output from each intermediate channel is of substantially the same relative amplitude as the output of said first and second signals attenuated in said leftmost channel and said rightmost channel.

2. The apparatus as defined in claim 1, including a central speaker located substantially at said midpoint, and a fifth audio output channel through which mixed and attenuated signals drive the central speaker at substantially the same amplitude as the other speakers.

3. The apparatus as defined in claim 2 wherein said attenuating means includes a pair of resistors respectively transmitting the first and second audio signals directly to the leftmost and rightmost speakers.

4. The apparatus as defined in claim 3 wherein said mixing means includes a plurality of voltage dividing resistors interconnecting the leftmost and rightmost channels to form junctions therebetween to which the intermediate and central speakers are coupled by the attenuating means.

5. The apparatus as defined in claim 2 wherein the attenuating means includes pairs of transformers respectively coupling both of the leftmost and rightmost channels to each of the central and intermediate speakers.

6. The signal distributing network as defined in claim 2 wherein said attenuating means includes pairs of resistors respectively connecting both of the leftmost and rightmost channels to each of the central and intermediate speakers.

7. The system as defined in claim 2 wherein said central speaker is located in symmetrical relation to the other of the speakers.

* * * * *